United States Patent [19]

McNeil

[11] Patent Number: 4,732,590

[45] Date of Patent: Mar. 22, 1988

[54] FLASH ECONOMIZER

[76] Inventor: John A. McNeil, 251 Butler St., Brookville, Pa. 15825

[21] Appl. No.: 7,609

[22] Filed: Jan. 28, 1987

[51] Int. Cl.[4] ..... B01D 51/00

[52] U.S. Cl. ..... 55/269; 55/274; 55/191; 55/204; 122/18; 122/367 A; 165/163

[58] Field of Search ..... 55/191, 204, 269, 274; 122/367 A, 18; 165/163

[56] References Cited

U.S. PATENT DOCUMENTS

| | | | |
|---|---|---|---|
| 3,608,279 | 9/1971 | West | 55/219 |
| 3,693,324 | 9/1972 | McNeil | 55/191 |
| 3,720,259 | 3/1973 | Fritz et al. | 165/163 |
| 3,788,044 | 1/1974 | McNeil | 55/204 |
| 3,898,068 | 8/1975 | McNeil | 55/426 |
| 4,471,836 | 9/1984 | Hokanson | 55/269 |

FOREIGN PATENT DOCUMENTS

| | | | |
|---|---|---|---|
| 1303351 | 11/1971 | Fed. Rep. of Germany | 165/163 |

*Primary Examiner*—Bernard Nozick

*Attorney, Agent, or Firm*—Parmelee, Miller, Welsh & Kratz

[57] ABSTRACT

A flash economizer employing an enclosed upright container has upper, intermediate and lower chambers for flashing pressurized blowdown effluent in the nature of moisture-contaminated steam. It is constructed to initially separate and remove pure steam in its upper so-called flashing chamber and to thereafter maximize, principally in the intermediate chamber, an indirect transfer of heat from the remaining heat-containing condensate or water to a clean effluent, such as make-up water. An upwardly spiraled tubing array positioned about and along the intermediate chamber receives the clean effluent and advances it in an upwardly spiraled counterclockwise path therealong, while the heat-containing condensate is directed in a downflow, counter or clockwise-spiraled path along the tubing array. The tubing array is carried by an enclosing support structure that defines a spiral downflow path for the heated condensate therealong and therabout. Enlarged inlet and outlet tubing members extend into and along the lower and into the intermediate chamber in a spaced relation with respect to each other, with the outlet or return tubing member extending along an inner periphery of the tubing array and along a substantially central supporting structure about which the array extends within the intermediate chamber. Downflow of heated condensate is proportioned to maintain a full spiral downflow within the enclosing structure along the tubing array while providing a central downflow along the inside of the central supporting structure.

9 Claims, 6 Drawing Figures

FLASH ECONOMIZER

This invention deals with a so-called flash economizer or steam separating apparatus that may be employed to continuously process blowdown issuing under pressure from a boiler to initially separate and take-off pure or dry steam therefrom for further usage, and to employ the remaining heat-containing condensate or water for heating a pure cold effluent such as water that may thereafter be introduced into and used in a deaerator or feed water heater.

Earlier flash separating equipment is exemplified by U.S. Pat. Nos. 3,693,324; 3,788,044 and 3,898,068.

It has been an object of this invention to provide an improved economizer apparatus that will have a greatly increased efficiency in its operation.

Another object has been to enable a maximized transfer of the heat content of condensate collected in a vortex-like-acting, pure or dry steam removing apparatus.

A further object has been to develop an economizer apparatus that will be foolproof and failproof and substantially automatic in its operation and that will, at all times, keep an operator fully informed as to its operating condition.

A still further object of the invention has been to devise an economizer apparatus which will enable a maximum pick-up or transfer of the heat of the content of a blowdown effluent being introduced therein.

These and other objects of the invention will appear to those skilled in the art from the illustrated embodiment, the specification and the appended claims.

Figures 1, 2, 3, 4, 5, 6:
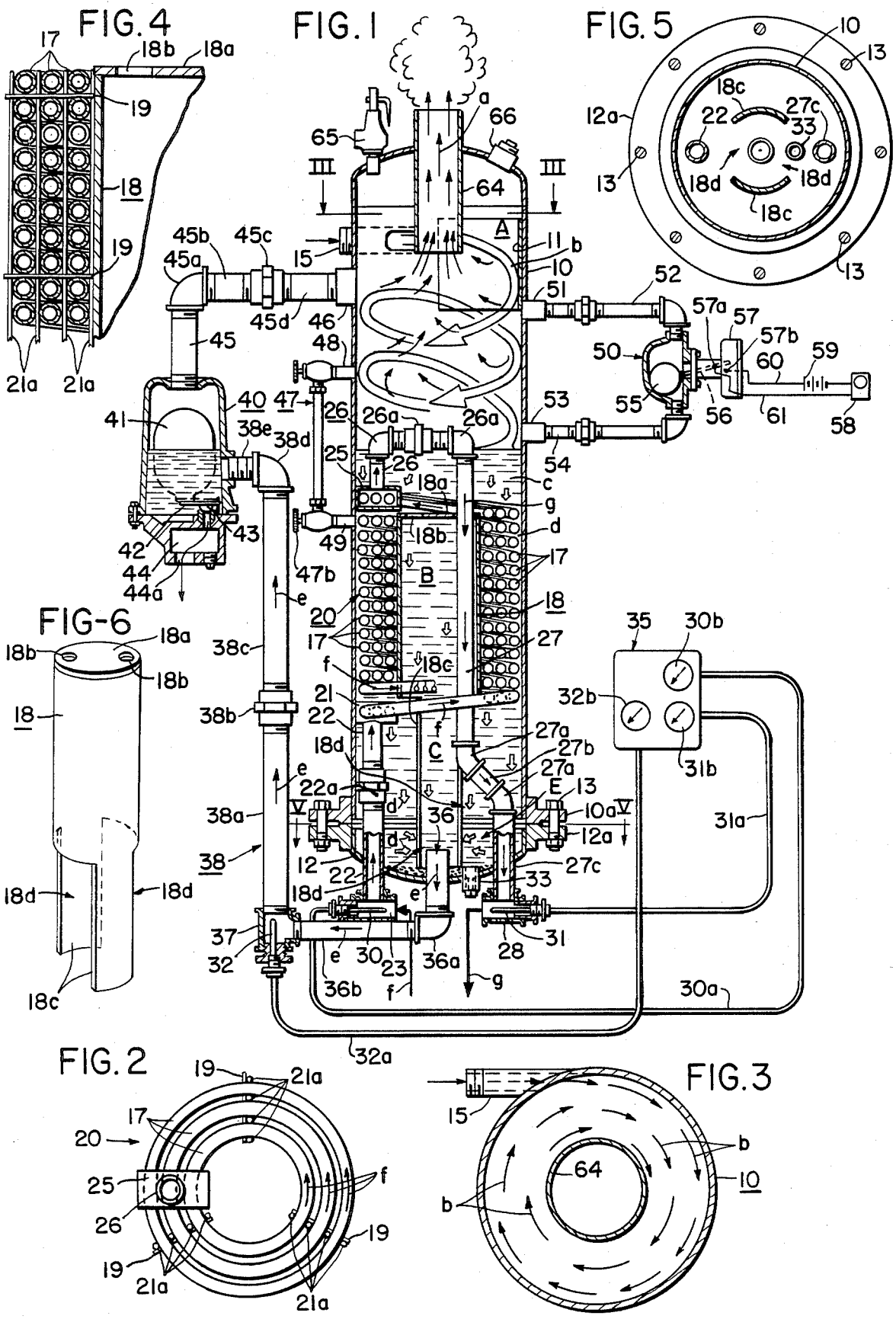
FIG. 1 is a vertical view in elevation and partial section illustrating an apparatus of the invention and control means therefore.
FIG. 2 is a plan view taken downwardly from a top tier of a tubing member array of and on the same scale as the apparatus shown in FIG. 1.
FIG. 3 is a horizontal section taken along line III—III of and on the same scale as FIG. 1.
FIG. 4 is an enlarged fragmental section through the tubing array showing its supporting, spiraled, compartmentalized, tier structure.
FIG. 5 is a horizontal section along line V—V of FIG. 1 through a lower portion of a container for the apparatus and on the scale of FIG. 1.

And, FIG. 6 is a vertical view in elevation of a central tubing-like member that, as shown in FIG. 1, extends from intermediate chamber B into lower chamber C.

DETAILED DESCRIPTION OF THE EMBODIMENT

Referring particularly to FIG. 1, I have shown a flash economizer having an elongated container 10 defining an upper, blowdown-receiving, flashing chamber A within which pressurized blowdown is introduced through side-positioned inlet 15 to, as indicated by arrows a, cause dry or pure steam to rise from a vortex-like, clockwise-swirling area, represented by the arrows b, for take-off from an inwardly projecting, centrally, endwise-positioned outlet pipe 64. The swirling vortex movement in the upper chamber A causes dry steam to be separated-out and wet, heat-containing condensate c to collect in a bottom portion of the chamber. The outlet or discharge pipe 64 may be connected to supply steam as needed for reuse directly to a deaerator or feed water heater. The heat-containing condensate c in the lower portion of the upper chamber A moves downwardly in a spiral, clockwise path d along a heat-exchange tubing array or assembly 20, and along an intermediate chamber B into a lower collecting chamber C. The cooled condensate is then removed from the bottom end of container 10 through a downpipe or discharge member 36, as indicated by the arrows e. The pipe 36 projects a slight distance above the bottom end wall of the container 10 to thus provide a sludge or sediment pocket from which sediment may be then removed by taking the screw plug out of a clean-out, inwardly threaded nipple 33.

It will be noted that, in addition to a heat transferring downflow of condensate in a spiral path in and about the tubing array 20, as indicated by the arrows d, there is also a down movement through a central compartment of intermediate chamber B, as defined by a centrally located cylindrical or tubing-like wall 18 that serves as a tier supporting structure. A top closing plate or end portion **18*a* of wall 18 has at least one small opening 18*b* therein through which condensate may enter (see FIGS. 1 and 6). The use of a restricted opening enables the maintenance of a level of condensate c within the bottom portion of the upper chamber A that covers, as shown in FIG. 1, both the top of the tubing array 20 and the top end of the cylindrical wall structure 18. It is important in carrying out the invention to maintain such a level, in order that a full, maximum amount of heat-containing condensate will pass along and about the outside of coiled heat-transferring, spiral tubing members 17 of the three-part array 20 in a downflow, clockwise spiral path therealong. It will be noted from FIGS. 2 and 4 that every seven or eight layers of tubing have horizontal, diagonally extending, tiering rods 19. The rods 19 and 21*a*** may be of ⅛ inch diameter steel construction and are shown spaced at equal distances apart on the diameter of the tube bundle or at 120°.

Also, as shown, vertical spacer rods **21*a* provide a separated relation between the tubing members of each layer of the tier. FIG. 2 shows the rods 21*a* in circumferentially equally spaced-apart groups of about 120° with respect to the coil tubing members 17 of the array 20 and, as abutted by cross-extending horizontal rods 19*a*. The rods 19*a*, as shown in FIG. 4, have a vertically spaced-apart, supporting relation across the tubing array. Also, as shown, the rods 21*a* along their vertical extent maintain the individual coils 17** in a transversely-horizontally spaced-apart relation with respect to each other.

The cylindrical wall structure 18 serves as an inner support for the tubing array or assembly 20 in the intermediate chamber B. As shown in FIGS. 1 and 6, structure 18 has a pair of leg portions **18*c* that extend into the lower chamber C and define a pair of liquid circulating open window portions 18*d*** therebetween. This enables water or condensate circulation within lower chamber C.

A sight tube assembly 47, as shown in FIG. 1, has its upper end 48 connected to the upper chamber A and its lower end 49 connected to the top of the chamber for the tubing array 20, in order to indicate whether or not, as shown, a proper level of heat-containing condensate is being maintained in the bottom of the chamber A. Also, a trap unit 40 is provided for automatically maintaining a proper condensate level in the bottom of the upper chamber A above and for flow into the tubing array or area assembly and into central downflow area of the intermediate chamber B. This is done by controlling the amount of outflow of water from the chamber C. Also, an alarm system 50 is provided which monitors the vortex portion of the flashing chamber A to automatically set-off an alarm to alert a distant operator if the condensate level rises above a proper level such as the level indicated in FIG. 1.

The trap unit 40 has a discharge or outlet valve 43 that is operated by a lever arm 42 which is connected to the bottom of a float 41 within a main chamber of the unit 40 in such a manner as to proportion the level of water within the unit 40 to the desired level of heated condensate in the lower portion of the upper or flashing chamber A of the container 10. The discharge of cooled water from the unit 40 from its main chamber, as controlled by the float 41 and valve 43, through a lower chamber 44 and its outlet 44*a* is proportioned to automatically maintain the indicated level of hot condensate within the bottom of the upper chamber A of the container 10. It will be noted that the main chamber of unit 40 is connected by a piping system 38 consisting of pipe members 38*a* and 38*c*, connector 38*b*, elbow 38*d* and inlet 38*e* through housing 37, pipe member 36*b* and elbow 36*a* to the condensate take-off pipe member 36. As indicated, the level of cooled condensate or liquid is maintained at the same level in the chamber A of the container 10 as in the main chamber of the unit 40. It will be noted that the upper end of the chamber of the unit 40 is connected through piping 45, elbow 45*a*, piping 45*b* and 45*d* and coupling 45*c* to connector or nipple 46 into the flashing chamber A, slightly below the blowdown entry inlet nipple or connector 15.

Again referring to FIG. 1, the lower end or bottom end portion of the container 10 and a closing-off bottom end wall 12 are shown provided with flanges 10*a* and 12*a* which are normally secured in a fluid-sealed-off relation by bolt and nut assemblies 13. Thus, bottom wall 12 may be dropped from time to time to clean out the inside of the container 10.

To give the operator further indication of the efficiency of operation of the device and to maximize the control of this operation, thermometer tubes 30, 31 and 32 are respectively mounted in an inlet housing 23 for the make-up water or effluent to be heated, in an outlet housing 28 for the heated make-up water, and in an outlet housing 37 for the cooled condensate being removed. Each of the housings 23, 28 and 37 has an appropriate temperature sensor, such as a thermometer bulb 30, 31 and 32 that contains a suitable temperature-sensitive liquid, such as mercury, and that is connected through respective fluid lines 30*a*, 31*a* and 32*a*, respectively, to temperature indicating dials 30*b*, 31*b* and 32*b* that are mounted on an indicator panel 35.

As also shown in FIG. 1, the alarm unit 50 is connected at its upper end through piping 52 and a nipple 51 into an intermediate area in the flashing chamber A and, at its lower end, is connected through piping 54 and a nipple 53 to a lower end of the upper flashing chamber A at a slight, upwardly spaced relation with respect to the desired water level therein. The unit 50 has a ball float 55 provided with a switch arm 56 extending therefrom and pivotly connected at 57*a* of a switch unit 57. An alarm, such as an electrical buzzer or bell 58 is connected at one terminal through a source of electrical energy, such as a battery or transformer 59 and line 60, to a switch point or contact 57*b* of the switch unit 57. The other or opposite electrical terminal of the alarm 58 is connected through line 61 to the switch arm 56 at its pivot mounting 57*a*. Thus, if the water level should, for some reason, due to a malfunction, raise up to a point where the heated condensate enters the piping 54 through nipple 53, it will raise the ball float 55 and thus, pivot the arm 56 about its pivot point 57*a* to provide a closed circuit between switch points 57*a* and 57*b* as effected by switch arm 56 to thus energize the alarm unit 58 and alert the operator whether or not he or she is in the immediate vicinity of the apparatus.

Make-up water to be heated may be introduced into the container 10 in a cooled state through the make-up inlet or connector housing 23 to progresses upwardly along an inside wall of bottom chamber C of the container 10 through piping 22 and coupling 22*a* into a bottom-positioned entry manifold or header 21. The lower end of the tubing array 20 is shown as having a three coil system made up of three spiraled, individual coils of a suitable metal, such as copper or nickel, whose lower inlet ends are open to the manifold or header 21. Thus, the make-up water to be heated progressively rises, as shown, in a counterclockwise spiral path f into an upper outlet manifold or header 25 and an outlet pipe 26 assembly that is connected together by a dielectric or electrically non-conductive coupling 26*a*. As shown, vertical portions of the pipe assembly 26 extend upwardly within and horizontal portions may rest on the surface area of the hot condensate c. The heated effluent or water is then delivered from the piping 26 to a vertical downpipe 27. The downpipe 27 extends along the vertical wall of 18 in a maximum spaced relation with respect to the inlet piping 22 to carry the now fully heated make-up water along the depth of the heat-transferring condensate in intermediate chamber B into the lower chamber C. Elbows 27*a* and dielectric connector 27*b* deliver the heated make-up water through downpipe 27*c* to output housing 28. The heated make-up effluent or water is thus flowed downwardly through along the full extent of the heat-containing condensate within the intermediate and lower chamber portions B and C of the container 10 to maximize heat pick-up before it is discharged from the outlet housing 28.

The construction, flow positioning of the make-up effluent or water enables a maximized heat extraction from the condensate and pick-up by the make-up water. It will be noted that the inlet pipe 22 for the make-up water or effluent to be heated and the outlet piping 27, etc. for the heated effluent are of a larger diameter than the individual tubing members 17 of the array 20, and that up and down pipes 22 and 27 extend within the container 10 in an opposite, spaced apart relation with respect to each other and in such a manner that the maximized transfer of available heat in the condensate is taken up by the make-up effluent. The overhead cross-extending connection piping 26 contributes considerably to the heat pick-up, since the members are located at a point of maximum heat, as represented by the bottom of the flashing chamber A, and above and along the level of the heat containing condensate therein.

With particular reference to FIGS. 1, 2 and 4, I have provided a greatly improved heat transfer system in which a maximized amount of the heat content of the condensate that is provided by the blowdown being introduced at 46 into the upper chamber A is utilized in heating make-up effluent being introduced at 22. The open portion 18*b* in the closing end portion 18*a* of the inner or central wall member 18 serves to provide a restricted flow of the heated condensate therein and thus, cooperates with the trap unit 40 to, as shown, maintain a height of liquid level c in the bottom portion of the upper or flashing chamber A. It also assures a full downflow of the heated condensate under gravity head dictated by the depth of the condensate as represented by c, along the outer spacing between the outside of the wall member 18 and the inner wall of the container 10. This assures a full and maximized flow of the heated condensate therealong in a maximized heat-transferring relation with respect to the tubing array 20.

In addition, the tubing array 20 is of an improved construction, utilizing a group or plurality of separate, upwardly spiraled coils or metal tubing units 17 that substantially fill the spacing between the inner side of the wall of the container 10 and the outer wall of the cylindrical part 18. Each coil 17 is of an integral construction and, at its lower and upper ends, is connected to a common inlet header 21 and outlet header 25. It will be apparent that a substantially free expansion and contraction of the coils of the array 20 is permitted throughout the full vertical extent of their convolutions.

As indicated in FIG. 4, vertical support of the array 20 is accomplished by the transverse or horizontally cross-extending rods 19 (see also FIG. 2) that are located at suitable spaced-apart, vertical positions along the tubing array and adjacent to and in abutment with the vertical spacer rods 21*a*. The spaced-apart relationship between the coils 17 is also important from the standpoint of not only permitting their expansion and contraction, but also enabling a full downflow of the heated condensate therealong to assure a maximized heat transferring relation as furthered by flow of the heated condensate along the central area of the intermediate chamber B.

I claim:

1. In a flash economizer for initially separating-out the dry steam content of a blowdown effluent and for then maximizing a transfer of the heat of its heat-containing condensate to a make-up effluent such as feed water wherein: an upright elongated enclosed processing container has an upper flashing chamber provided with a side inlet for introducing blowdown effluent therein and an upper outlet for removing flashed dry steam therefrom, has an intermediate heated condensate receiving and make up liquid circulating and heating chamber, has a lower cooled condensate receiving and discharging chamber provided with an outlet for discharging cooled condensate, and has a centrally positioned and vertically extending cylindrical inner wall member extending along its said intermediate chamber; said inner wall member having a cross-extending closing-off top end wall provided with at least one relatively small open portion therein for restricted entry of heated condensate into said inner wall member, said inner wall member being open at its lower end into said lower chamber, said inner wall member defining thereabout an outer circular condensate-downflow area in a radially inwardly spaced relation with respect to and along a side wall of said container, a heat-exchange tubing array positioned to extend vertically along and to substantially fill said downflow area; said array having a group of continuous individual vertically extending heat-exchange coils, each said coil having upwardly spiraled convolutions in a substantially cross-aligned and in a spaced relation with convolutions of the other coils of the group, a lower header in an upper end of said bottom chamber to which lower ends of said coils are connected to receive make-up effluent to be heated, an upper header in a lower end of said upper flashing chamber to which upper ends of said coils are connected to deliver heated make-up effluent thereto, means set to assure maintenance of a level of heated condensate in the lower end of said flashing chamber above said closing-off top end wall and said upper header and in cooperation with said open portion to provide a full and maximum downflow of heated condensate along and about said coils of the tubing array as well as a downflow along and within said inner wall member into said lower chamber, first means connected to said lower header to supply make-up effluent to be heated thereto, and second means connected to said upper header for removing heated make-up effluent therefrom.

2. An improved flash economizer as defined in claim 1 wherein, means is connected to said upper flashing chamber for warning an operator when the heated condensate raises above a safe operational level within said flashing chamber.

3. An improved flash economizer as defined in claim 1 wherein an alarm device is connected between upper and lower portions of said upper flashing chamber to give warning to an operator if and when the level of heat-containing condensate therein rises above a desired depth.

4. An improved flash economizer as defined in claim 1 wherein, circumferentially spaced-apart vertically extending spacer rods are positioned to extend along and between convolutions of said coils to maintain them in a spaced-apart relation along the vertical extent of said array, and horizontally cross-extending support rods are positioned along said vertically-extending rods to support the convolutions of said coils along the vertical extent of said outer downflow area.

5. An improved flash economizer as defined in claim 1 wherein, said vertically extending spacer rods are substantially equally spaced circumferentially with respect to said tubing array, and said horizontally extending spacer rods are positioned at vertically spaced-apart locations along the vertical extent of said tubing array.

6. An improved flash economizer as defined in claim 1 wherein said first and second means connected to said lower and upper headers for supplying make-up effluent to be heated and for removing heated make-up effluent therefrom are tubes of an enlarged diameter with respect to said coils of the tubing array.

7. An improved flash economizer as defined in claim 1 wherein said open portion is of a size proportioned to further the maintenance of a full downflow of heated condensate along said outer heated condensate downflow area and about said coils of the tubing array into said lower chamber.

8. An improved flash economizer as defined in claim 1 wherein, an operator's indicator panel is provided with temperature indicators thereon, a temperature sensor is positioned in each said first means, second means and said discharge outlet, and means operatively connects said sensors to said indicators on said operator's indicator panel.

9. An improved flash economizer as defined in claim 1 wherein said cylindrical inner wall member has a lower end portion of reduced diameter that extends along said lower chamber and has a pair of legs defining open portions therebetween.

* * * * *